US005370379A

United States Patent [19]

Wyer

[11] Patent Number: 5,370,379

[45] Date of Patent: Dec. 6, 1994

[54] SHEET REGISTRATION AND FEEDING APPARATUS

[75] Inventor: Andrew F. Wyer, Comberton, England

[73] Assignee: Xerox Corporation, Stamford, Conn.

[21] Appl. No.: 968,894

[22] Filed: Oct. 30, 1992

[30] Foreign Application Priority Data

Dec. 12, 1991 [GB] United Kingdom ..... 9126400

[51] Int. Cl.[5] ..... B65H 5/22; B65H 31/00; B65H 1/30

[52] U.S. Cl. ..... 271/3.1; 271/121; 355/319

[58] Field of Search ..... 355/318, 319, 320; 271/3.1, 121

[56] References Cited

U.S. PATENT DOCUMENTS

| | | | |
|---|---|---|---|
| 4,166,614 | 9/1979 | Hamlin et al. | 271/3.1 |
| 4,229,101 | 10/1980 | Hamlin et al. | 271/3.1 X |
| 4,368,973 | 1/1983 | Silverberg | 355/318 X |
| 4,456,235 | 6/1984 | Colglazier et al. | 271/3.1 |
| 4,515,357 | 5/1985 | Hamlin | 271/121 X |
| 4,538,906 | 9/1985 | Brown | 355/319 |
| 4,553,828 | 11/1985 | Burger et al. | 355/318 |
| 4,629,311 | 12/1986 | Kaneko et al. | 355/319 |
| 4,887,806 | 12/1989 | Tanaka et al. | 271/121 |
| 5,008,713 | 4/1991 | Ozawa et al. | 271/121 X |

*Primary Examiner*—Fred L. Braun

[57] ABSTRACT

A sheet registration and feeding apparatus includes a sheet stacker for compiling sheets delivered serially thereto into a stack. The sheet stacker includes a support surface, a registration member for registering sheets to form a registered stack and a sheet separator-feeder for separating and feeding sheets seriatim from the compiled stack to a feeder for feeding the sheets along a sheet path away from the support surface. An interposer is included in the form of a pivotally mounted elongate member with hooked fingers at one end thereof configured to intercept an incoming sheet fed onto the support surface or onto the stack such that the incoming sheet is intercepted by the fingers without interrupting an outgoing sheet being fed simultaneously out from the support surface or from the bottom of the stack to the feeder.

16 Claims, 5 Drawing Sheets

SHEET REGISTRATION AND FEEDING APPARATUS

The present invention relates to a sheet registration and feeding apparatus for sheet material and is particularly, although not exclusively, useful for registering and feeding copy paper sheets in xerographic copying apparatus.

Sheet registration and feeding apparatus normally employ a sheet stacker for compiling sheets into a stack and a sheet separator-feeder for separating and feeding sheets one at a time from the compiled stack. The sheet stacker may comprise a tray into which the sheets are delivered and means for registering the sheets to form a registered stack against a registration stop. The sheet separator feeder may comprise a nudger roll disposed beneath the stack and arranged for intermittent operation for feeding sheets one at a time from the bottom of the registered stack to the nip defined between a retard roll and an intermittently-operated feed roll. The arrangement is such that when only one sheet is presented to the nip, the grip of the feed roll on the sheet is greater than the retardation applied to the sheet by the retard roll, so that the sheet is fed when the roll is driven. However, when two sheets enter the nip, the friction between the sheets is sufficiently low to permit the bottom sheet in contact with the feed roll to be fed, whereas the top sheet has so little force applied to it by the bottom sheet's movement that the friction applied by the retard roll brings the top sheet to a standstill, at least until it comes into contact with the feed roll by removal of the bottom sheet by feeding.

When delivering a sheet of paper to a duplex tray difficulty is sometimes encountered with registering the lead edge prior to feeding out. Also with a duplex tray configuration incorporating a bottom sheet feeder there could be the occasion when, without any restriction, the incoming sheet could overtake the stack of sheets in the tray and be fed out at the same time as the bottom sheet. This problem is illustrated schematically in FIG. 1 of the accompanying drawings in which sheets are compiled in a stack 2 in a duplex tray 4, the sheets being fed into the tray 4 one by one with the aid of a top nudger roll (not shown). The bottom sheet S1 of the stack 2 is fed out intermittently by intermittently-operated nudger rolls 6 (only one of which is shown) to the nip defined between a feed roll 8 and a retard roll 10. Difficulty arises when incoming sheets slide over the stack 2 so as to overtake the stack 2. In FIG. 1 an incoming sheet S2 is shown arriving while a previous incoming sheet S3 is shown as having overtaken the stack 2 with its leading edge already within the nip defined by the rolls 8, 10.

It is an object of the present invention to provide a sheet registration and feeding apparatus which will eliminate the possibility of a previous incoming sheet overtaking an already formed stack to the extent that the previous incoming sheet causes disruption to the sheet feeding operation.

Accordingly, the present invention provides a sheet registration and feeding apparatus including sheet stacking means for compiling sheets delivered serially thereto into a stack, said sheet stacking means comprising a support surface, registering means for registering sheets to form a registered stack and sheet separator-feeder means for separating and feeding sheets seriatim from said compiled stack to a feeder for feeding said sheets along a sheet path away from said support surface, wherein there is provided interposing means adapted to intercept an incoming sheet fed onto said support surface or onto said stack whereby said incoming sheet is intercepted by said interposing means without interrupting an outgoing sheet being fed simultaneously out from said support surface or from the bottom of said stack to said feeder.

In one embodiment the interposing means is in the form of an elongate member one end thereof being hooked for intercepting said incoming sheet and in a preferred embodiment said hooked end is provided with at least one finger member for intercepting said incoming sheet. In one embodiment said elongate member is pivotally mounted at its other end remote from said at least one finger member, and in a further preferred embodiment said at least one finger member interleaves with slots in a front wall of said feeder.

In one embodiment said other end of said elongate member is pivotally mounted to a shaft carrying upper nudger rolls for feeding the sheets one at a time towards said support surface, said other end of said elongate member being pivotally mounted to said shaft at at least one location on said shaft defined between a pair of said nudger rolls. In a further embodiment, said shaft is connected to a guide member pivotally mounted on a further shaft, said further shaft being operably coupled to drive means whereby said further shaft can be rotated at least intermittently. Said shaft carrying said nudger rolls is operably coupled to said further shaft whereby rotation of said further shaft results in rotation of said shaft carrying said nudger rolls. Conveniently, said shaft carrying said nudger rolls is operably coupled to said further shaft by means of a belt and pulley arrangement.

In a preferred embodiment said elongate member is arranged to rest under its own weight, with its hooked end in a throat area of said feeder, when there are no sheets, or only a few sheets, on said support surface whereby the lead edge of an advancing sheet is intercepted by said hooked end which acts as a registration stop. There is a gap between said support surface and said elongate member when said elongate member is in its rest down position, said gap being of a height, approximately 2 mm, to accommodate a relatively small number of stacked sheets. Said throat area, immediately adjacent to an end of said support surface, for receiving sheets fed from said support surface, is tapered to a height exceeding the height of said gap, for example to a height of approximately 4 mm.

In a preferred embodiment, said hooked end of said elongate member remains "hooked" over the edge of a stack until as the height of the stack of sheets increases said front wall of said feeder takes over as the registration stop for incoming sheets.

Also in a preferred embodiment, said elongate member is provided with a heel portion at a location along its length, said heel portion being positioned relative to at least one bottom "D" shaped nudger roll whereby rotation of said at least one bottom nudger roll contacts the bottom sheet on said support surface and lifts the stack sufficiently to engage said heel portion, thereby ensuring that a normal force is felt by the stack so that the bottom sheet of the stack can be advanced to said feeder.

The support surface may be the surface of a duplex buffer tray. Thus, in another aspect of the invention, there is provided a copier for duplex copying including a photoreceptor, a copy sheet tray, a duplex buffer tray, sheet feeders associated with said trays for feeding sheets from said trays to the photoreceptor, a fuser for fixing images received on said sheets at the photoreceptor, a sheet return path for conveying simplex sheets which have received an image on one side at the photoreceptor to said duplex buffer tray from said fuser for refeeding to the photoreceptor to receive a second image on the other side, wherein said duplex buffer tray is associated with a sheet registration and feeding apparatus in accordance with embodiments of the invention.

The invention will be described further by way of example with reference to the accompanying drawings in which.

Figure 1:
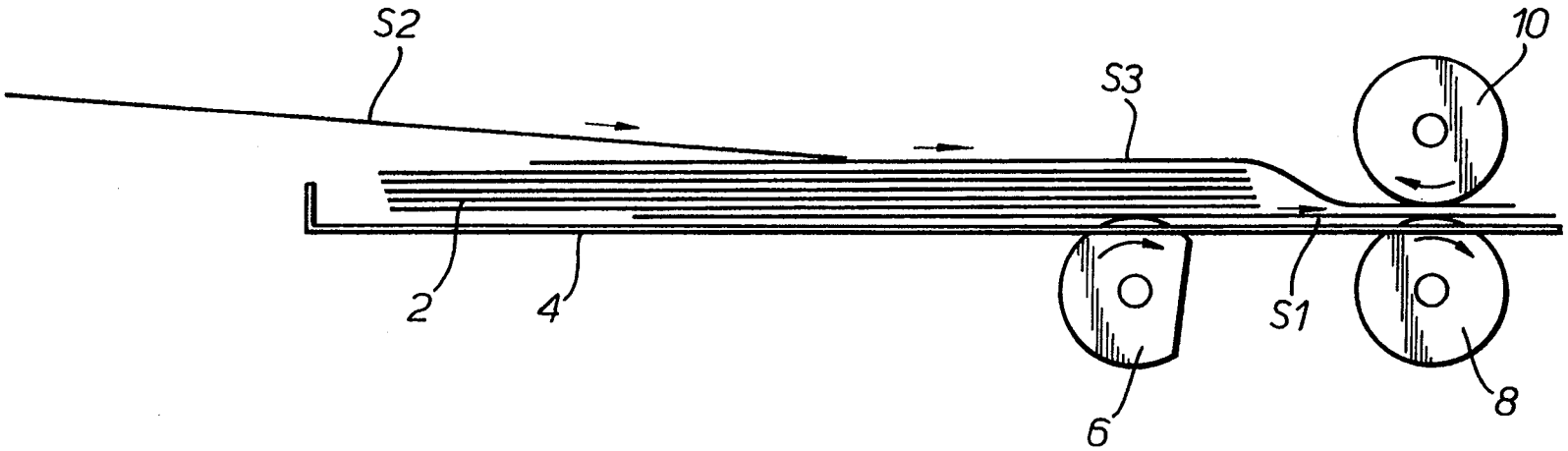
Fig. 1. (PRIOR ART)
FIG. 1 illustrates schematically a known separator-feeder arrangement.

FIG. 1 has been described above as an illustration of the manner in which incoming sheets S3 can slide over a stack 2 to the extent that they effectively overtake the stack 2 and interfere with the feeding out of a bottom sheet 51 from the stack 2. This difficulty is overcome by the present invention one embodiment of which will now be described with reference to FIGS. 2 to 6 in which similar reference numerals refer to similar features. It is to be understood that there is no intention to limit to the described embodiment. On the contrary, the aim is to cover all alternatives, modifications, and equivalents falling within the scope of the invention as defined by the appended claims.

Figure 2:
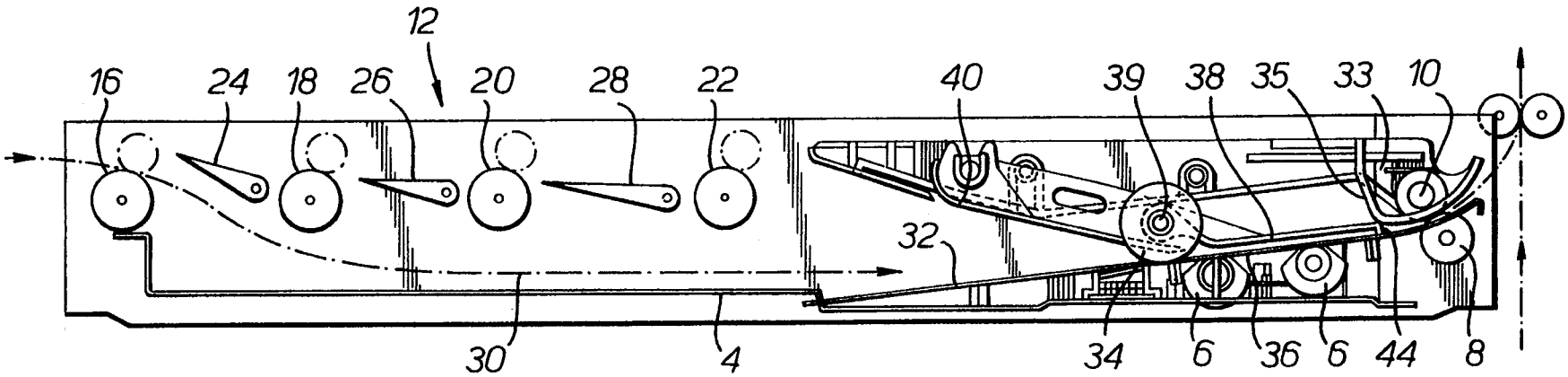
FIG. 2 is a cross-sectional side view of a sheet registration and feeding apparatus in accordance with an embodiment of the present invention.

Referring to FIG. 2 of the accompanying drawings, the incoming sheets are fed via a diverter section 12 into the duplex tray 4. The diverter section 12 comprises four pairs of feed rollers 16, 18, 20 and 22, each pair feeding incoming sheets of a particular size into the duplex tray 4. Each adjacent pair of feed rollers 16,18, 20 and 22 has a pivotally mounted diverter arm 24, 26 and 28 therebetween. In FIG. 2 the diverter arm 24 is shown pivoted in its upward position allowing sheets of size A3 to enter the duplex tray 4 along a sheet path shown by a dashed line 30. Each of the sheets is fed up the surface of a guide 32 of the tray 4 until the leading edge of the sheet locates in a nip defined between the surface of the guide 32 and a plurality of top nudger rolls 34 (only one of which is illustrated in FIG. 2). The top nudger rolls 34 are mounted at spaced locations along an axle 39 which is intermittently operated in,synchronism with the arrival of the sheets so as to feed the sheets one at a time into an area of the duplex tray 4 above the bottom nudger rolls 6 where they are compiled in a stack on a support surface 36.

Immediately above the support surface 36 is a pivoted interposer device 38, the purpose of which is to intercept the incoming sheet without interrupting sheets being fed out at the same time. The interposer device 38 also provides the normal force required for the operation of the bottom nudger rolls 6 which advance the bottom sheet in the stack into the nip defined between the feed roll 8 and the retard roll 10 of a feeder 33. The feeder 33 is provided with a front registration and guide wall 35. The pivot for the interposer device 38 coincides with a shaft 39 on the ends of which are mounted the upper nudger rolls 34. The nudger rolls 34 are supported on a pivoted guide 40 and rise with the height of the stack of paper fed into the tray 4.

Figure 3:
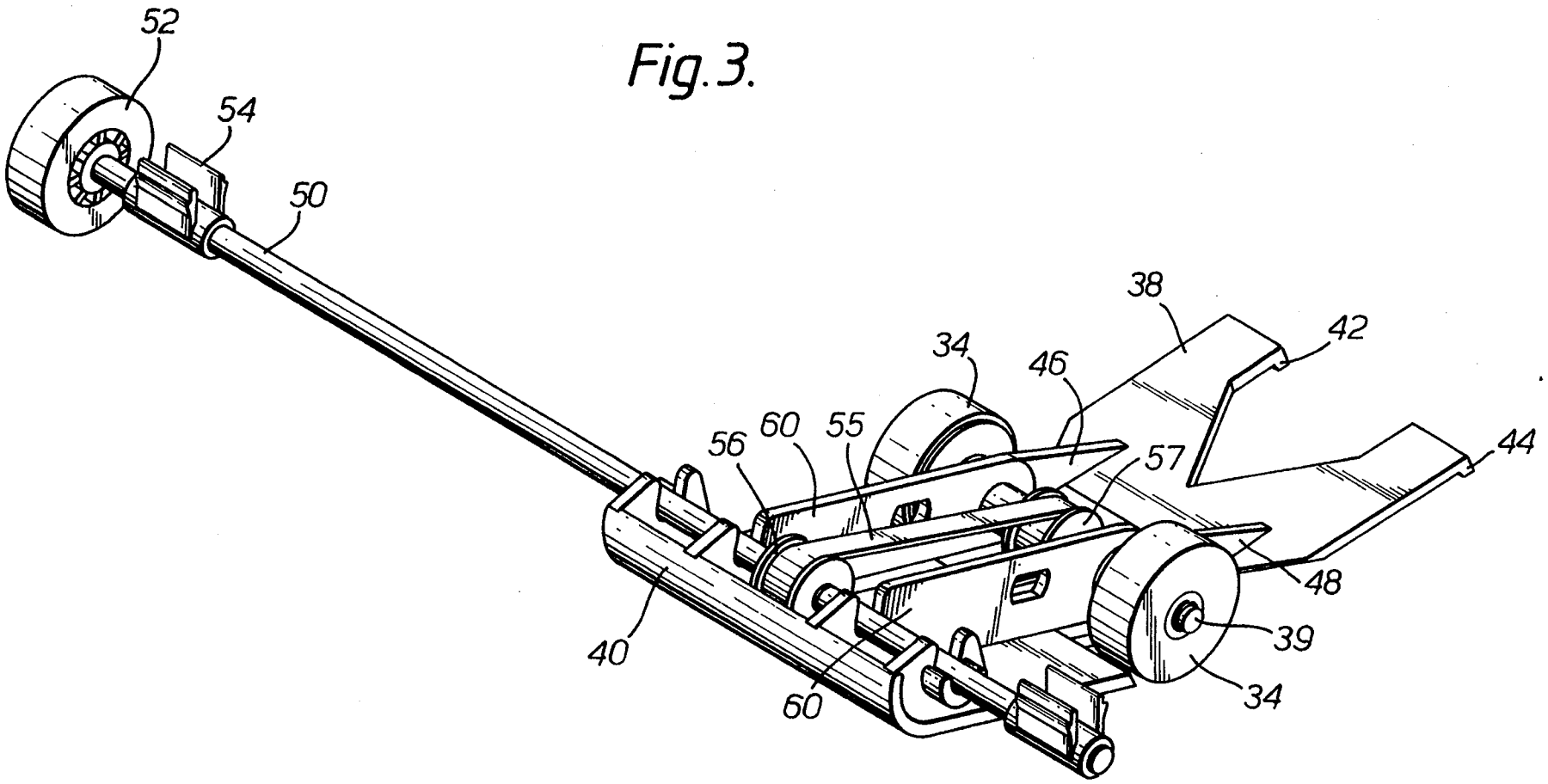
FIG. 3 is a detail of FIG. 2 illustrating the interposer device and its mounting.
Figure 4:
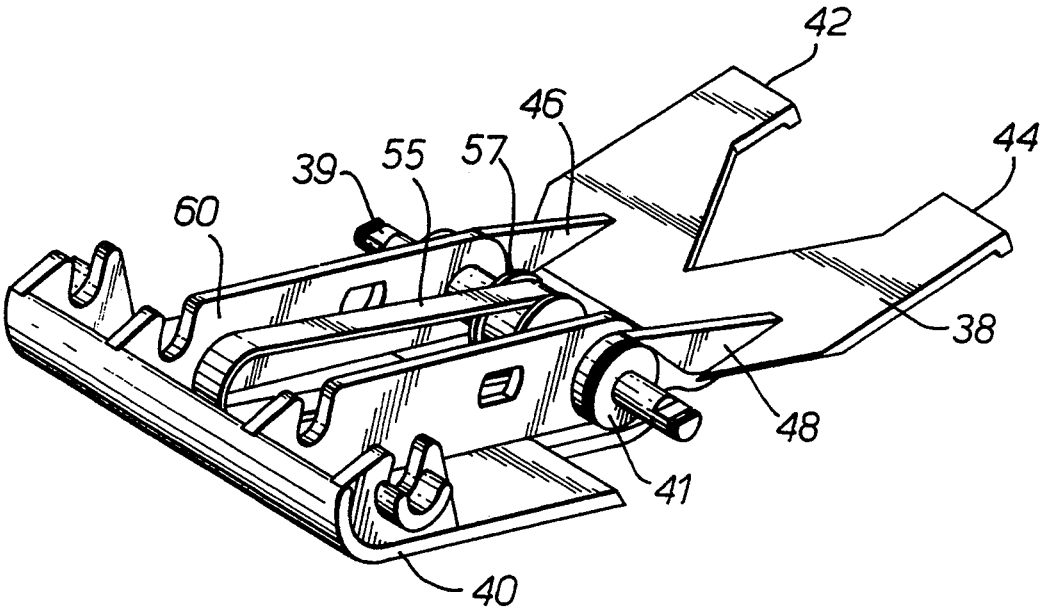
FIG. 4 is a detail of FIG. 3 illustrating the interposer device mounted on a guide.

The interposer device 38 and its mounting arrangement are shown in more detail in FIGS. 3 and 4. The interposer device 38 is formed as a substantially flat member, conveniently made from plastics material, having one of its ends bifurcated to define two hooked interposer fingers 42, 44. The opposite end of the interposer device 38 is attached to two supports 46, 48 each of which is pivotally mounted by plastic bearings 41 (see FIG. 4) on the shaft 39 just inboard of the nudger rolls 34. The shaft 39 passes through the ends of two spaced walls 60 which form a middle portion of the guide 40, also made of plastics material, which is itself pivotally mounted on a shaft 50 one end of which is attached for rotary motion to a drive gear 52 by means of snap-fit bearings 54. Intermittent rotation of the shaft 50 is communicated to the shaft 39, and thereby to the nudger rolls 34, via a belt 55 and pulley arrangement 56, 57.

Figure 5:
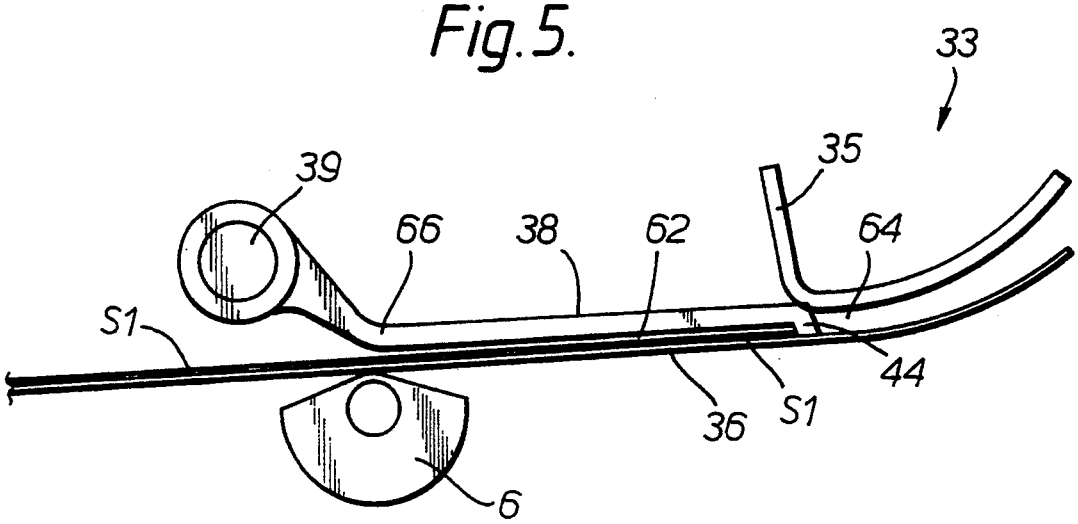
FIG. 5 shows the interposer of FIG. 3 in its lowest position.
Figure 6:
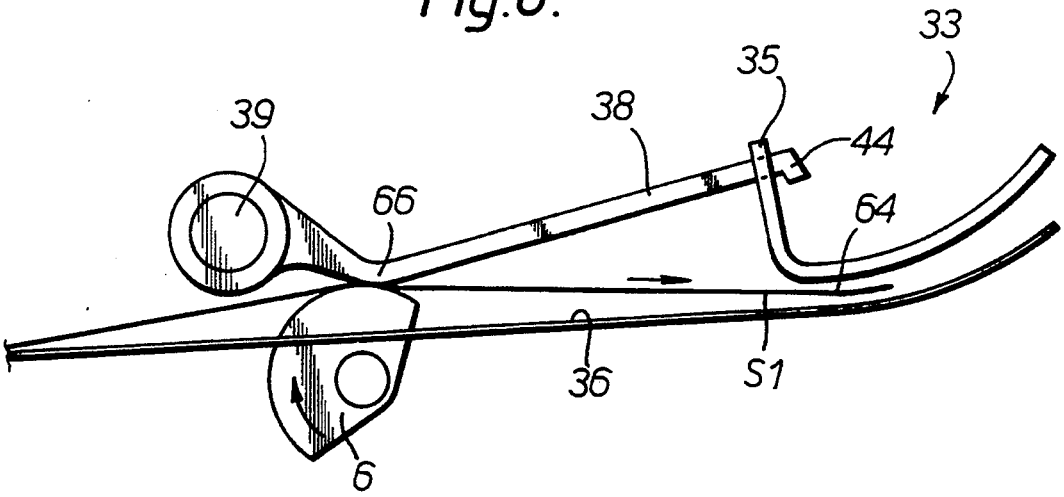
FIG. 6 shows the interposer of FIG. 3 in a high position.

Referring back to FIG. 2, and also with reference to FIGS. 5 and 6, it can be seen that the interposer fingers 42, 44 interleave with slots formed in the front guide wall 35 of the feeder 33.

In operation the first incoming sheet is fed into the tray 4 and is guided beneath the interposer device 38 which rests down onto the tray 4 under its own weight. This prevents the lead edge of the sheet from advancing into the feeder (see FIG. 5). Initially, a gap 62 of approximately only 2 mm exists between the interposer device 38 and the support surface 36 of the tray 4, which gap 62 is sufficient to accommodate only a few sheets of paper. A throat area 64 of the feeder 33 tapers to approximately 4 mm. As described earlier, the interposer fingers 42, 44 interleave with the front wall 35 of the feeder 33 through slots which accommodate them.

As the height of the stack of paper increases, the interposer device 38 (see FIG. 6) lifts with the top nudger rolls 34, which may be lifted or driven as and when necessary. The interposer fingers 42, 44 still remain "hooked" over the stack edge until the front wall 35 of the feeder 33 takes over as the registration stop for incoming sheets When a sheet is to be fed out of the duplex tray 4, the bottom "D" shaped nudger rolls 6 rotate to contact the bottom sheet on the support surface 36 and lift the stack sufficiently to engage a "heel" 66 of the interposer device 38. A normal force is felt and the sheet advances into the feeder 33. With a large stack the interposer device 38 remains well out of the way of the lead edge of the sheets to be fed. When the stack height reduces the interposer fingers 42, 44 will lower into the throat area 64 but engage with the bottom nudger rolls 6 more directly and will unhook from the lead edge zone of a bottom sheet which is to be fed away.

The sheets are also effectively disengaged from the interposer fingers 42, 44 by the interleaving with the feeder front wall 35.

Whereas the specific embodiment described above relates to a sheet registration and feeding apparatus for use in a copier it will be appreciated to those skilled in the art that the invention can find application in other fields. For example, the apparatus could be used for handling banknotes in automated bank teller (ATM) machines.

I claim:

1. A sheet registration and feeding apparatus including sheet stacking means for compiling sheets delivered serially thereto into a stack, said sheet stacking means comprising:

a support surface;

registering means for registering sheets to form a registered stack;

a sheet separator-feeder means for separating and feeding sheets seriatim from said compiled stack;

a feeder for receiving said sheets from said separator-feeder and feeding said sheets along a sheet path away from said support surface; and interposing means in the form of an elongate member that includes one end thereof being hooked and provided with at least one finger member to intercept an incoming sheet fed onto said support surface or onto said stack; and wherein said at least one finger member interleaves with slots in a front wall of said feeder whereby said incoming sheet is intercepted by said interposing means without interrupting an outgoing sheet being fed simultaneously out from said support surface or from the bottom of said stack to said feeder.

2. The sheet registration and feeding apparatus as claimed in claim 1, wherein said elongate member is pivotally mounted at its other end remote from said hooked end.

3. The sheet registration and feeding apparatus as claimed in claim 2, wherein said other end of said elongate member is pivotally mounted to a shaft carrying upper nudger rolls for feeding the sheets one at a time towards said support surface.

4. The sheet registration and feeding apparatus as claimed in claim 3, wherein said other end of said elongate member is pivotally mounted to said shaft at at least one location on said shaft defined between a pair of said nudger rolls.

5. The sheet registration and feeding apparatus as claimed in claim 4, wherein said shaft is connected to a guide member pivotally mounted on a further shaft.

6. The sheet registration and feeding apparatus as claimed in claim 5, wherein said further shaft is operably coupled to drive means whereby said further shaft can be rotated at least intermittently.

7. The sheet registration and feeding apparatus as claimed in claim 6, wherein said shaft carrying said nudger rolls is operably coupled to said further shaft whereby rotation of said further shaft results in rotation of said shaft carrying said nudger rolls.

8. The sheet registration and feeding apparatus as claimed in claim 7, wherein said shaft carrying said nudger rolls is operably coupled to said further shaft by means of a belt and pulley arrangement.

9. The sheet registration and feeding apparatus as claimed in claim 8, wherein said elongate member is arranged to rest under its own weight, with its hooked end in a throat area of said feeder, when there are no sheets, or only a few sheets, on said support surface whereby the lead edge of an advancing sheet is intercepted by said hooked end which acts as a registration stop.

10. The sheet registration and feeding apparatus as claimed in claim 9, wherein a gap is included between said support surface and said elongate member when said elongate member is in its rest down position, said gap being of a height to accommodate a relatively small number of stacked sheets.

11. The sheet registration and feeding apparatus as claimed in claim 10, wherein said throat area, immediately adjacent to an end of said support surface, for receiving sheets fed from said support surface, is tapered to a height exceeding the height of said gap.

12. The sheet registration and feeding apparatus as claimed in claim 11, wherein said gap has a height of approximately 2 mm.

13. The sheet registration and feeding apparatus as claimed in claim 11, wherein the height of said throat area is approximately 4 mm.

14. The sheet registration and feeding apparatus as claimed in claim 13, wherein said hooked end of said elongate member remains "hooked" over the edge of a stack until as the height of the stack of sheets increases said front wall of said feeder takes over as the registration stop for incoming sheets.

15. The sheet registration and feeding apparatus as claimed in claim 14, wherein said elongate member is provided with a heel portion at a location along its length, said heel portion being positioned relative to at least one bottom "D" shaped nudger roll whereby rotation of said at least one bottom nudger roll contacts the bottom sheet on said support surface and lifts the stack sufficiently to engage said heel portion, thereby ensuring that a normal force is felt by the stack so that the bottom sheet of the stack can be advanced to said feeder.

16. The sheet registration and feeding apparatus as claimed in claim 15, wherein said support surface is the surface of a duplex buffer tray.

* * * * *